US005382335A

United States Patent [19]

Jirenec et al.

[11] Patent Number: 5,382,335

[45] Date of Patent: Jan. 17, 1995

[54] PROCESS AND APPARATUS FOR THE ELECTROLYTIC TREATMENT OF CONTINUOUSLY ADVANCING ELECTRICALLY CONDUCTIVE MATERIAL

[75] Inventors: Karl Jirenec, Maria Enzersdorf; Jovan Starcevic, Vienna, both of Austria

[73] Assignee: Andritz-Patentverwaltungs-Gesellschaft m.b.H., Graz, Austria

[21] Appl. No.: 891,943

[22] Filed: Jun. 1, 1992

[30] Foreign Application Priority Data

Jun. 10, 1991 [AT] Austria ..... 1160/91

[51] Int. Cl.[6] ..... C25F 1/04; C25F 7/00

[52] U.S. Cl. ..... 204/144.5; 204/145 R; 204/206; 204/211

[58] Field of Search ..... 205/147; 204/144.5, 204/141.5, 145 R, 206, 211

[56] References Cited

U.S. PATENT DOCUMENTS

| | | | |
|---|---|---|---|
| 2,759,888 | 8/1956 | Rendel | 204/211 |
| 3,536,601 | 10/1970 | Hill et al. | 204/211 X |
| 3,865,700 | 2/1975 | Fromson | 205/139 |
| 4,129,485 | 12/1978 | Shikata et al. | 204/145 R |
| 4,326,933 | 4/1982 | Sabatka et al. | 204/206 X |
| 4,391,685 | 7/1983 | Shepard et al. | 204/145 R |
| 5,022,971 | 6/1991 | Maresch et al. | 204/145 R |

FOREIGN PATENT DOCUMENTS 2431554 2/1980 France .

*Primary Examiner*—Donald R. Valentine
*Attorney, Agent, or Firm*—Ladas & Parry

[57] ABSTRACT

Process for the electrolytic pickling of continuously advancing electrically conductive material, wherein the treatment periods as compared with purely chemical treatments are to be shortened respectively the length of the treatment plant is to be shortened and wherein the attack of aggressive ions onto the electrode material is to be counteracted for the attainment of longer life expectancies, in particular of the anode. The material to be treated is subjected to at least one cathodic treatment in a first vessel and merely an anodic treatment in an immediately following vessel, and the electrical circuit between the electrodes of different polarities in successive vessels is completed by way of the material being treated. In the apparatus according to the invention at least one anode dips into one of the successive vessels, whereas all electrodes in the immediately following vessel are of cathodic polarity.

24 Claims, 11 Drawing Sheets

PROCESS AND APPARATUS FOR THE ELECTROLYTIC TREATMENT OF CONTINUOUSLY ADVANCING ELECTRICALLY CONDUCTIVE MATERIAL

BACKGROUND OF THE INVENTION AND PRIOR ART

The invention relates to a process for the electrolytic pickling of continuously passing electrically conductive material, in particular metal strip, metal wires or metal profiles, wherein the material successively passes through at least two vessels charged with aqueous electrolyte and wherein the material is subjected to an electric current, as well as an apparatus for carrying out the process.

For the treatment of electrically conductive materials many types of processes are known which employ an electric current, optionally merely for the promotion of the processes. Thus, for example metal strips are electrolytically coated respectively electrolytically pickled. Depending on the manner in which the electric voltage is applied to the strip such processes are sub-divided into two groups, the direct and the indirect processes.

In the direct method the metallic object is directly polarised as a cathode or anode. In large scale pickling plant for the continuous treatment of materials passing therethrough, in particular metal strip, such direct method of current application by means of current take-off rollers, brushes or similar means failed to make the grade because of poor conductivity of the uppermost mill scale layers. Industrial installations have been and still are invariably designed for the application of indirect methods of current application. In this context the metallic strip is passed between pairs of electrodes which alternatingly exhibit opposite polarities. The electric current passes from one electrode by way of the pickling solution to the strip through which it flows preferentially because of the superior conductivity of the metal before being discharged at the next pair of electrodes.

Indirect treatments are for example disclosed in EP-A 93 681 and in EP-A 395 542 which disclose processes and apparatus for the electrolytic coating of elongate metal objects respectively electrically conductive substrates, wherein these work pieces are continuously passed through at least two electrolyte baths. In this context the electrolytes may be the same or different compositions may be employed.

In the respective first bath a cathode is provided and the work piece is therefore anodic, and an anode is provided in the bath intended for coating, such that the work piece is cathodically polarised. The electric circuit is completed by way of the material being treated.

Both aforesaid patent specifications in no way deal with the different problems arising in pickling processes and give no indication as to how the attack by the aggressive ions to which the anode material is subjected, may be counteracted.

Further examples for the electrolytic treatment according to the indirect method are for example the preliminary pickling of super-refined steel in neutral salts, for example sodium sulphate and the subsequent final pickling in mineral acids, for example sulphuric or mixed acids (nitric acid and hydrofluoric acid) such a process is described in AT-PS-252 685.

In AT-PS 39 1 486 a dual stage process for the electrolytic pickling of super-refined steel is described in which in both stages pickling takes place in aqueous neutral salt solutions, alternatingly under anodic and cathodic conditions. In that case electrolyte solutions are also used which contain for example nitrate and fluoride anions, which result in highly aggressive solutions and which therefore subject the anode material to severe attack. This results in comparatively short life expectancies of the anode and accordingly impairs the economics of this process.

Moreover, in many situations no process is known which provides satisfactory results without subsequent mixed acid post-treatment in which the aforesaid anions are likewise present. In all of the aforesaid electrolytic processes the material to be treated is pickled alternatingly anodically and cathodically in the same vessel. This alternating anodic and cathodic treatment takes place also in the regions involving aggressive electrolyte solutions which contain for example fluoride, chloride or nitrate anions, so that in those cases the problem of correct selection of the anode material has not yet been solved economically. Whereas in sulphuric acid solutions respectively neutral electrolytes containing sulphate anions lead anodes have proven themselves, because they are, once being passivied they are subjected to only slight erosion, other anode materials such as for example carbon electrodes or highly alloyed steels as well as carriers coated with more noble metals suffer from the drawback of relatively short life expectancies in conjunction with the aforesaid aggressive ions and of altogether poorer economics due to the increased investment costs. The material which is subjected to anodic polarity is pickled away in the aggressive media and even in the case of coated anodes a dissolution of the coating and resultant rapid erosion of the anode material has been observed in conventional plant, for example in the presence of chloride ions.

Accordingly a need exists to provide a more economic process for the continuous preliminary pickling or complete pickling of electrically conductive materials, in particular of strip metal, metal wires or profiles in which on the one hand in order to improve the treatment effect and to shorten the treatment duration aggressive electrolyte solutions can be employed in conjunction with electric support and which on the other hand, with a view to improved economics, provides long life expectancies of the electrodes, in particular the anodes and low costs as a result of the selection of advantageous anode material.

A need also exists for an apparatus for carrying out such a process.

SUMMARY AND GENERAL DESCRIPTION OF THE INVENTION

The invention provides a process as set out in the opening paragraph in which the material passes through at least one treatment unit and in the course thereof successively passes through at least two vessels charged with aqueous electrolyte, a cathodic treatment in a first vessel being succeeded merely by an anodic treatment in an immediately following vessel, in the course of which electric current from at least one electrode of the first vessel being conducted by way of the material being treated to an electrode of the second vessel and an electric circuit being completed by the material between the electrodes of different polarities provided in the successive vessels.

As a result it is possible to select in each treatment vessel the optimal combination of electrode material and electrolyte for the specific pickling purpose. Obviously this applies even in the case where in both vessels the same electrolyte is used at least with regard to composition. Accordingly the electric circuit between the electrodes of different polarities is no longer completed within one and the same vessel, but instead it connects two mutually separate vessels, the electric circuit between the vessels being completed by the electrically conductive material continuously passing therethrough. For that reason it is possible to provide in each electrolyte only electrodes of a single polarity which can then be adapted accurately to the respective electrolyte and its properties, in particularly the unions present therein. For example in the baths in which the strip is of cathodic polarity and, accordingly the electrodes of anodic polarity, electrolyte-anode combinations can be employed in which due to passivication reactions the electrodes are coated with a protective coating and as a result are subjected to only minor erosion. Examples for this are electrolytes comprising sulphate ions and lead anodes, electrolytes comprising chloride ions and graphite anodes or electrolytes comprising nitrate ions and super-refined steel anodes. On the other hand in those baths in which the strip is of anodic polarity and the electrodes are of cathodic polarity, a variety of highly aggressive electrolyte solutions can be employed because the electrodes due to their polarities are protected against the aggressive ions, such as for example fluoride, chloride, sulphate, nitrate ions or optional combinations thereof. Accordingly even with those electrolytes only little cathode erosion is experienced.

The parameters of the aqueous solutions can be varied within wide limits with respect to temperature, composition and/or combinations as well as treatment durations and conditions. However, it was found in this context that the treatment periods due to the electric current support are generally shorter than in the case of conventional chemical treatments, for which reason the installations for any given throughput capacity can be constructed shorter. Besides the aforesaid advantages of cheaper electrodes subjected to less erosion, the shortened pickling periods and accordingly smaller plant sizes and also the improved treatment results, surface quality improvements are attained corresponding to electric polishing, and a further advantage of the process according to the invention resides in the fact that it is possible by adjusting the current density to attain a predetermined material erosion during pickling in order to keep the pickling losses low. Even the environmental impact can in many cases be reduced substantially. Those conventional processes in particular which provide for purely chemical mixed acid post-treatments suffer from the disadvantage that the nitric acid required as an electron donor results in emissions of nitric oxides. In accordance with the invention the metal oxidising effect is attained by virtue of the electric current, so that in many cases electrolytes comprising nitrate ions can be dispensed with and minimal decomposition to nitric oxides takes place even if they are used. Moreover, when changing the material to be treated it is usually not necessary to change the plant with respect to electrolyte composition or length of the treatment vessels, since the different treatment requirements can be met by simple adjustment of the current density. As a result the aforesaid changes may also involve shorter set-up and shut-down times.

The process in accordance with the invention is particularly advantageously applicable in the first instance to the preliminary pickling or full pickling of scaled metallic strip such as for example super-refined steel, high carbon steel, alloyed steels as well as special purpose metals.

According to one modification of the process according to the invention provision may be made for the material in the vessel for the cathodic treatment to be also subjected to treatment with alternating polarity by passage past electrodes of alternating polarities.

Because in the treatment of metallic materials many electrolytes are not aggressive or only slightly so, it is obviously possible to provide in a single vessel both anodes as well as cathodes for the treatments in such electrolytes. The anodes would for example be protected in such electrolyte solutions by passivication reactions, whilst the cathodes are protected against the anions present in the electrolyte by virtue of their polarities.

In order to keep losses resulting from a long pathway to be bridged at a low level it is preferably provided that the flow of current through the material to be treated is generated between those electrodes of successive vessels which are closest to one another.

As indicated above it is possible according to an additional integer of the invention to treat the material in successive vessels with electrolytes of different properties, in particular different compositions and more specifically in respect of the anions being present, subject likewise to the aforementioned advantages. The best treatment results were obtainable if the material in the first vessel is subjected to a treatment in neutral electrolyte or only slightly aggressive electrolyte and in the subsequent vessel to a treatment in an aggressive electrolyte. By this expedient it may be avoided, even if electrolyte is carried over between successive vessels, that the electrode in the second vessel is attacked, because firstly only neutral or slightly aggressive electrolyte is introduced and on the other hand, the electrode, due to its being polarised as a cathode, is protected against the attack by negatively charged ions. However, in order to maintain the electrolyte composition with as little change as possible, provision is made to avoid the carryover of electrolyte between the individual baths of each treatment unit, advantageously, in that the material is cleaned of carried over electrolyte at least when leaving one vessel or entering the subsequent vessel. Obviously the material to be treated may also be subjected to a neutralising treatment.

Particularly favourable treatment results are attained by an embodiment of the process in which the material in one of the successive vessels is treated both anodically as well as cathodically in an electrolyte of low aggressiveness and is treated in a second vessel exclusively anodically in an aggressive electrolyte. In order to further improve the treatment results, the material may be subjected to at least two cathodic and two anodic treatments and be introduced into a further vessel and be cleaned of carried over electrolyte, respectively be neutralised in respect thereof between the last cathodic and the next following last anodic treatment.

However, the carrying over of electrolyte here addressed is only of importance in the context of aggressive ions which may enter into less aggressive electrolyte solutions. In that situation the aforesaid ions may then attack the electrode material resulting in damage and reduced life expectancy. Accordingly in such situations a cleaning of the material to be treated, either mechanically, for example by squeegee rollers or by liquid or gaseous media, such as for example water or compressed air, is necessary. A carrying over of the less aggressive electrolyte on the other hand remains immaterial and accordingly in such situations the cleaning procedures may be reduced or omitted.

Advantageously a plurality of treatment units of the same or similar nature and the material to be treated is then cleaned of carried over electrolyte respectively is neutralised in respect thereof between the treatment units.

In order to protect the electrodes in the aggressive electrolyte against attack by the anions during standdown periods of the plant, e.g. when the material to be treated has been removed and in similar situations, provision is made in such situations to subject these electrodes to a protective voltage in order to prevent damage or erosion of the electrode material.

The electric current support even in the last stage of the pickling treatment, in particular in the aggressive electrolyte offers the further advantageous effect that due to the control of the current a controlled material erosion and a substantial reduction of pickling losses can be attained. For that purpose the voltage drop between the material to be treated and the last electrode viewed in the direction of passage of the material is determined and the material is removed from the pickling unit on registration of a voltage jump. The aforesaid voltage jump indicates that the erosion of the material to be removed, i.e. the mill scale, has been completed and signals that: the surface of the material to be treated has been reached.

For optimal pickling results provision is made that the material to be treated is passed for the anodic treatment through a vessel the electrolyte of which contains aggressive ions such as for example fluoride, chloride, sulphate or nitrate ions or optional combinations thereof.

The apparatus for carrying out the process comprises at least one treatment unit with at least two successive vessels for aqueous electrolyte viewed in the direction of passage of the material, in each vessel at least one electrode being provided and at least one anode dipping into the first of the successive vessels, and all electrodes in the immediately following vessel being cathodically polarised.

If with the same protective effect for the electrodes the modification of the process is to be conducted in which, in one of the vessels a treatment takes place with alternating polarity, it is essential that the apparatus comprises at least two successive vessels for electrolyte viewed in the direction of passage of the material, at least two electrodes of different polarity being provided in the first vessel. In such apparatus the electrodes closest to one another of successive vessels will then have different polarities. In both of the aforesaid modifications of the apparatus according to the invention it is ensured that in the second vessel only one type of electrode need be provided and that the electric current required for the electric treatment is provided by virtue of the connection of the two successive vessels by way of the material to be treated.

Preferably the successive vessels with electrodes of different polarities are charged with aqueous electrolyte of different proximities, in particular different composition.

In this context the first vessel is advantageously charged with a neutral electrolyte or an electrolyte of weak aggressiveness and the immediately following vessel is charged with aggressive electrolyte containing for example fluoride, chloride, sulphate or nitrate ions or optional combinations thereof.

In order to reduce the consumption of electrolyte and to prevent intermixing of the electrolyte liquors it is provided in accordance with an additional feature that between any two of the successive vessels cleaning means are provided for the material to be treated respectively neutralising means for carried over electrolyte.

Advantageously at least one electrode each of different polarities of two successive vessels, preferably the electrodes closest to one another, are interconnected by way of a source of current. This results by simple circuitry in the creation of an electrical circuit passing from the source of current by way of the first electrode and electrolyte to the material being treated, which in turn creates the connection to the second electrode provided in the other vessel. The latter electrode is in turn connected to the source of current.

Since as described further above it is also possible for a plurality of such or similar units to be connected in series in which at least two vessels are interconnected for the creation of an electric circuit in the aforesaid manner, it is advantageous to prevent the carry over of electrolyte liquor between the individual units, in particular of aggressive electrolyte into less aggressive electrolyte, in that according to a further feature of the invention between any two vessels with electrodes of different polarities, preferably vessels the electrolytes of which are not interconnected, cleaning installations for the material to be treated respectively chemical treatment units, in particular neutralising baths, are to be provided.

Finally, even in plant comprising divided electrodes in the vessel for the anodic treatment provision is preferably made for all electrodes in this second vessel to be made of the same material in order to provide an optimal adaptation to the electrolyte.

BRIEF DESCRIPTION OF THE DRAWINGS

In the following some preferred working examples of the invention are to be described more fully with reference to the accompanying figures of the drawings which schematically illustrate the respective apparatus for carrying out the process. There is shown in.

DESCRIPTION OF SPECIFIC AND PREFERRED EMBODIMENTS

Figure 1:
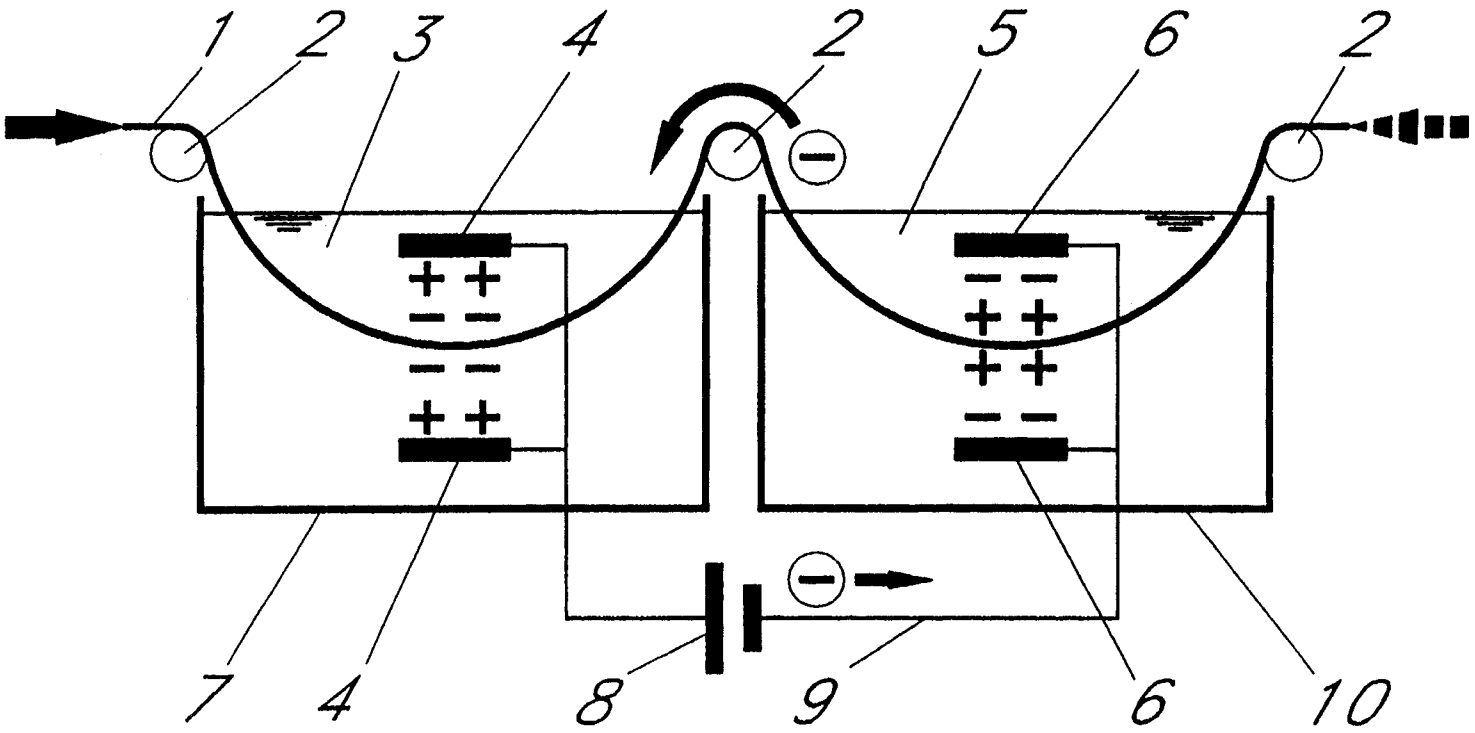
FIG. 1 an apparatus according to the basic embodiment.
Figure 2A:
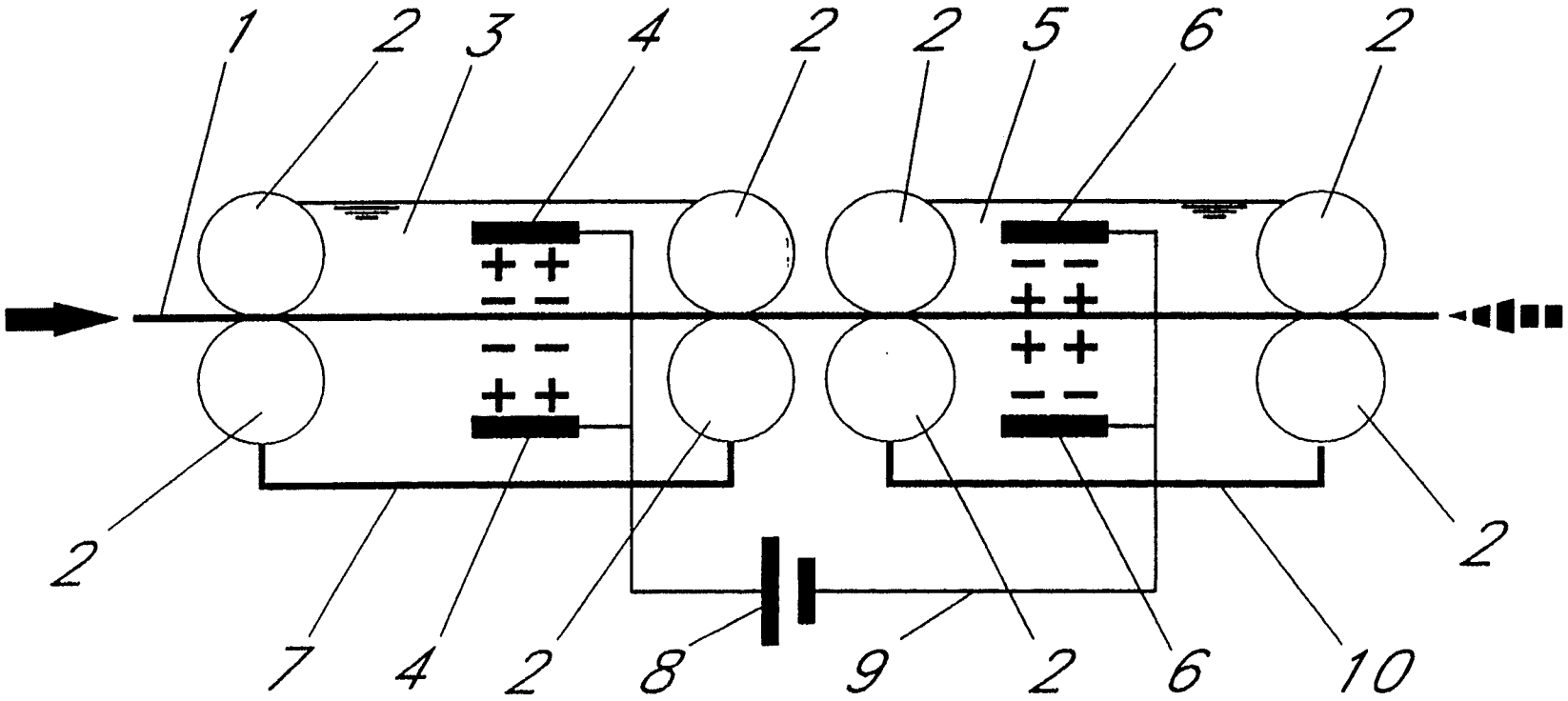
FIG. 2*a* to 2*c* further embodiments of this basic modification.
Figure 2B:
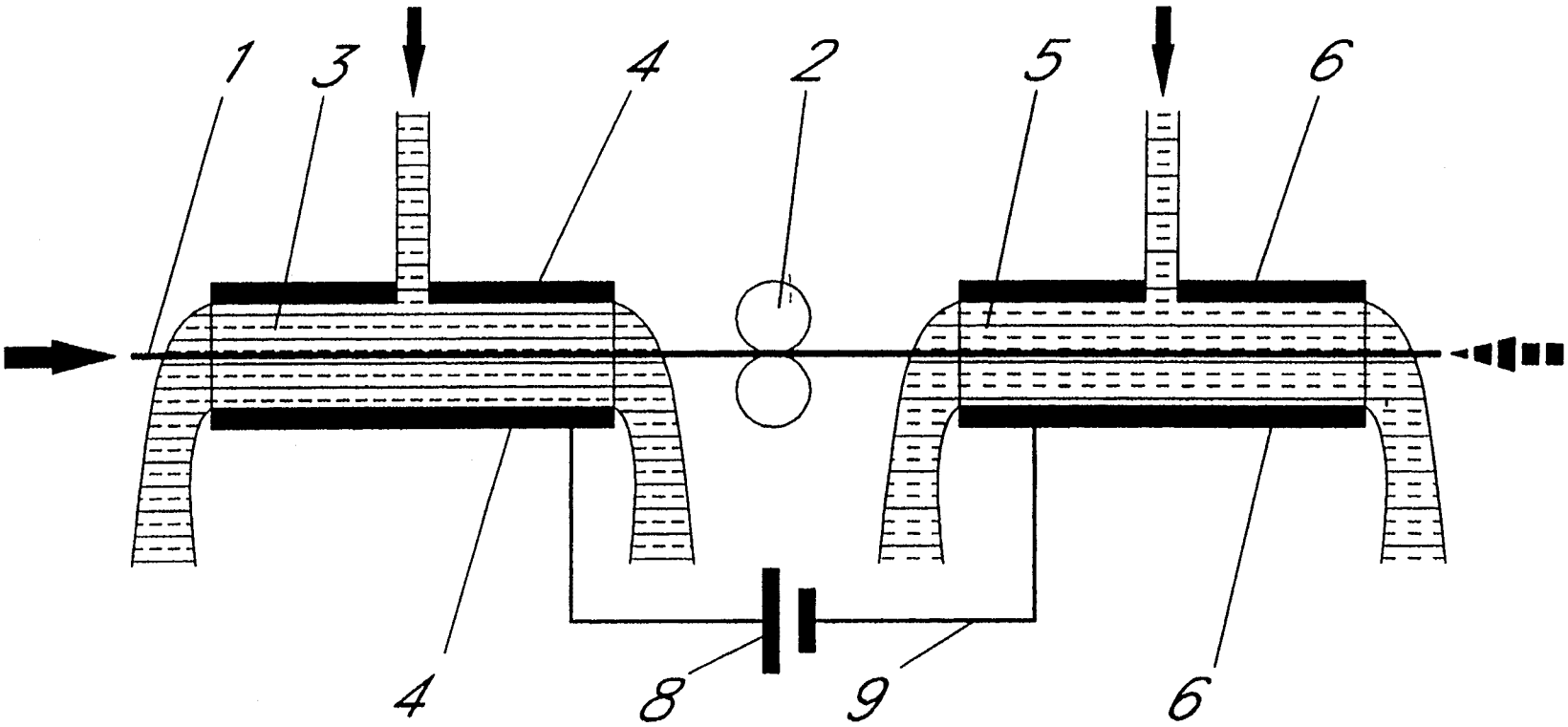
Figure 2C:
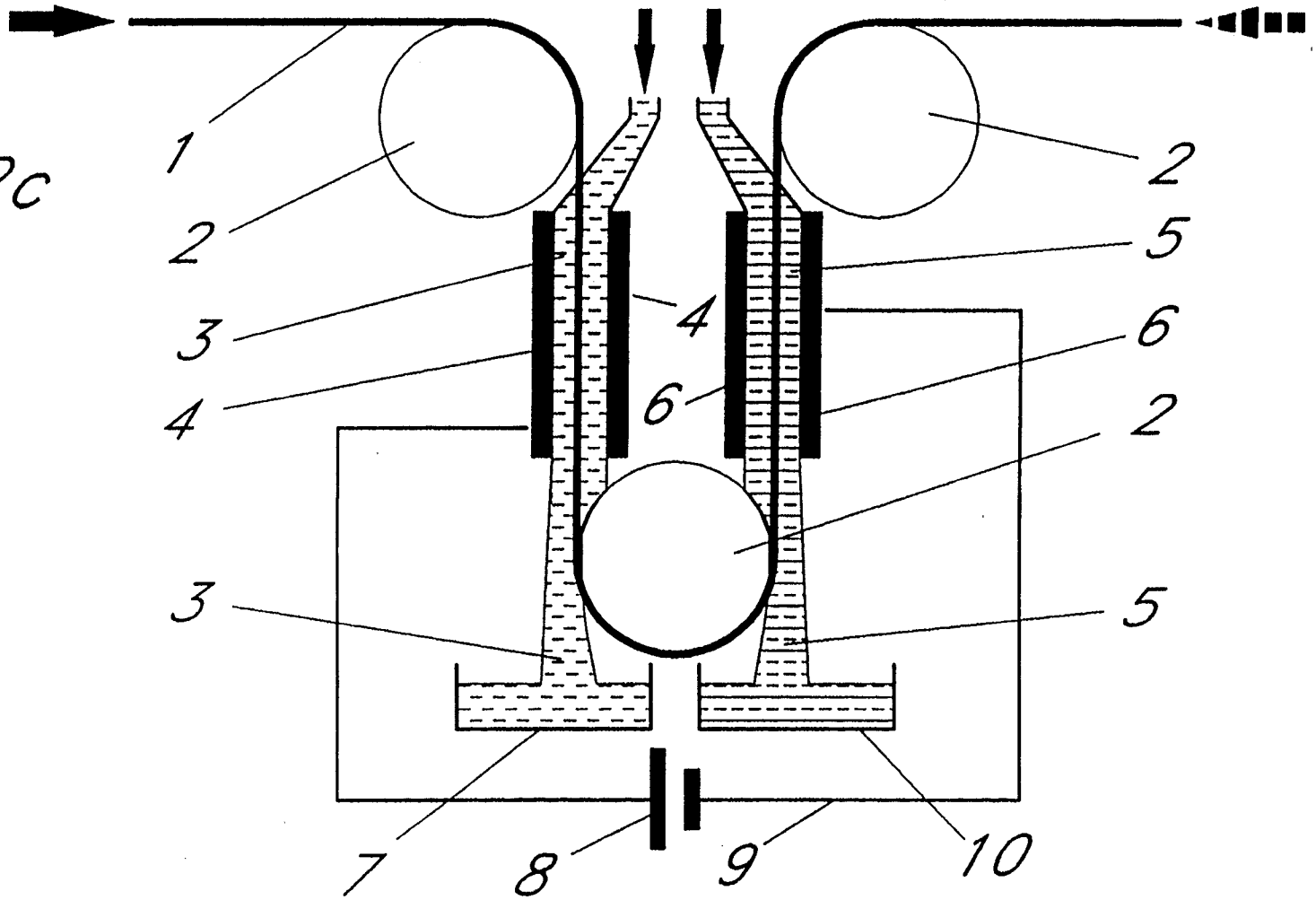

The following description is to be read in conjunction with and against the background of the aforegoing general description of the invention.

The material to be treated, in the illustrated case a metal strip or a metal wire, or a profile if so desired, is denoted as 1. Strip 1 is transported and guided through the plant by conventional driven and/or idling rollers 2. The strip is to be treated cathodically in a vessel 7 for example a conventional pickling vessel. For that purpose, for example, two mutually opposing electrodes 4 are provided which are polarised as anodes. The strip 1 is passed between the two electrodes 4 and is cathodically polarised. A first electrolyte 3, for example, a neutral electrolyte, e.g. an aqueous sodium sulphate solution is provided in the vessel 7. In that case lead electrodes are used as anodes which become coated with a lead sulphate layer and are subjected therefore to only minor erosion. It would also be possible to use the other matching combinations of electrolyte anion and electrode material (chlorine-graphite, . . . ).

In the next following vessel 10 the mutually opposing electrodes 6 are of cathodic polarity i.e. are protected in that manner, for which reason inexpensive materials may be used. The electrolyte 5 in that vessel 10, for use in pickling applications, is usually a highly aggressive solution which may for example contain fluorine ions, chlorine ions, nitrate ions, etc., as well as mixtures thereof. For that purpose mineral acids can be used or neutral salt solutions may be employed which contain the appropriate anions.

The electrodes 4 of the first vessel 7 are preferably interconnected with the electrodes 6 of the second vessel 10 by way of a conductor 9 and by way of a power source 8. As indicated by the arrows, the electrical circuit is completed by way of the electrically conductive material passing through between the two vessels 7 and 10. Accordingly, electron current flows from the current source 8 by way of the conductor 9 to the electrodes, for example 6 and from there through the electrolyte 5 onto the strip 1, onwards by way of the strip from the vessel 10 to the vessel 7 from where it once again returns from the strip 1 by way of the there existing electrolyte 3 onto the electrode 4 and finally again by way of the conductor 9 to the source of current 8.

Other embodiments of the basic modification are illustrated in FIGS. *2a* to *2c*. In FIG. *2a* the material to be treated is passed completely straight through the two vessels 7, 10, and the guide rollers 2 simultaneously serve for sealing the vessels 7, 10. However, the connection of the two electrodes 4, 6 takes place in the same manner as described above. Also in the embodiment according to FIG. *2b* the material 1 to be treated is passed horizontally and is supported between the two treatment localities by a pair of rollers 2 which in this case simultaneously serves as a pair of squeegee rollers. The treatment spaces are in this embodiment formed by the electrodes 4 respectively 6 which are horizontally arranged and through which the electrolytic liquids 3, 5 respectively flow. However, the electrodes 4, 6 are interconnected in a manner analogous to the previous examples by way of a source of current 8 and conductor 9.

The embodiment of FIG. *2c* likewise operates with a flowing electrolyte. However, in this case the electrodes 4, 6 are vertically arranged and the material 1 to be treated is guided through the treatment cells by way of deflecting and guide rollers 2.

In all the above described and still following figures the solidly drawn arrow indicates the direction of passage of the material being treated and pickled. The dashed arrow indicates the direction of electron current flow in the material 1. Of course, those skilled in the art will appreciate the fact that the convention for current flow is normally from positive to negative and therefore current flow is opposite to the shown direction of electron flow.

Figure 3:
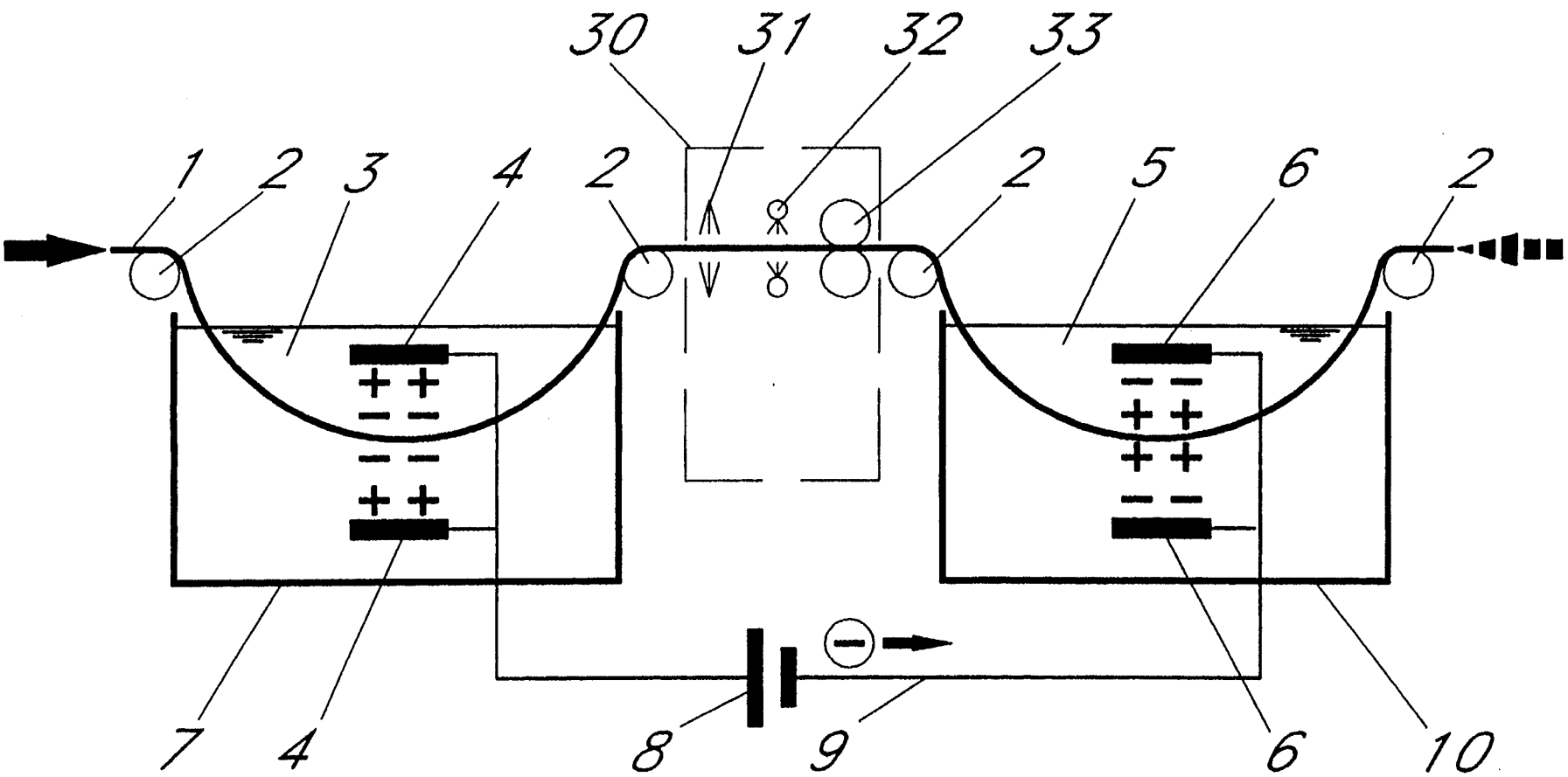
FIG. 3 the basic embodiment with an added cleaning unit.

In FIG. 3 once again a plant corresponding to FIG. 1 is illustrated, wherein, however, a cleaning unit 30 is provided between the successive vessels 7, 10. In this cleaning unit 30 individual or optional combinations of rinsing means 31, nozzles 32 for compressed air or other gaseous media respectively squeegee rollers 33 may be present. This cleaning unit 30 serves to prevent the carrying over of electrolyte 3 into the electrolyte 5.

Figure 4:
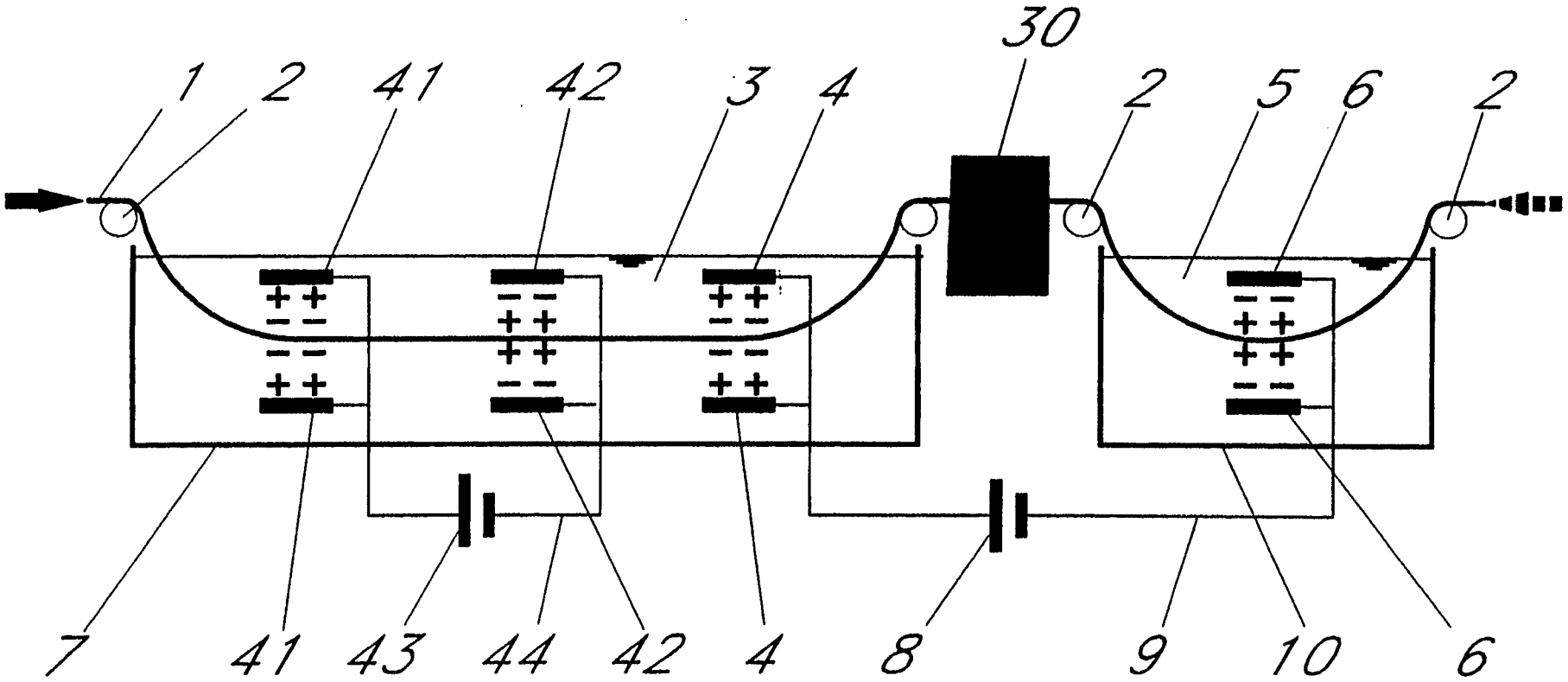
FIG. 4 a further modification in which the material is treated in one of the vessels with different polarity, FIG. 5*a* an embodiment in which one of the electrolytes used is effective purely chemically even without electrical current support, FIG. 5*b* a combination of the processes as illustrated in FIG. 4 and FIG. 5*a*, FIG. 6*a* and 6*b* in each case two treatment units connected in series separated from one another by a neutralisation or cleaning unit, and FIG. 7 finally a series of treatment units according to the invention which are separated from one another by cleaning units of the same type.
Figure 5A:
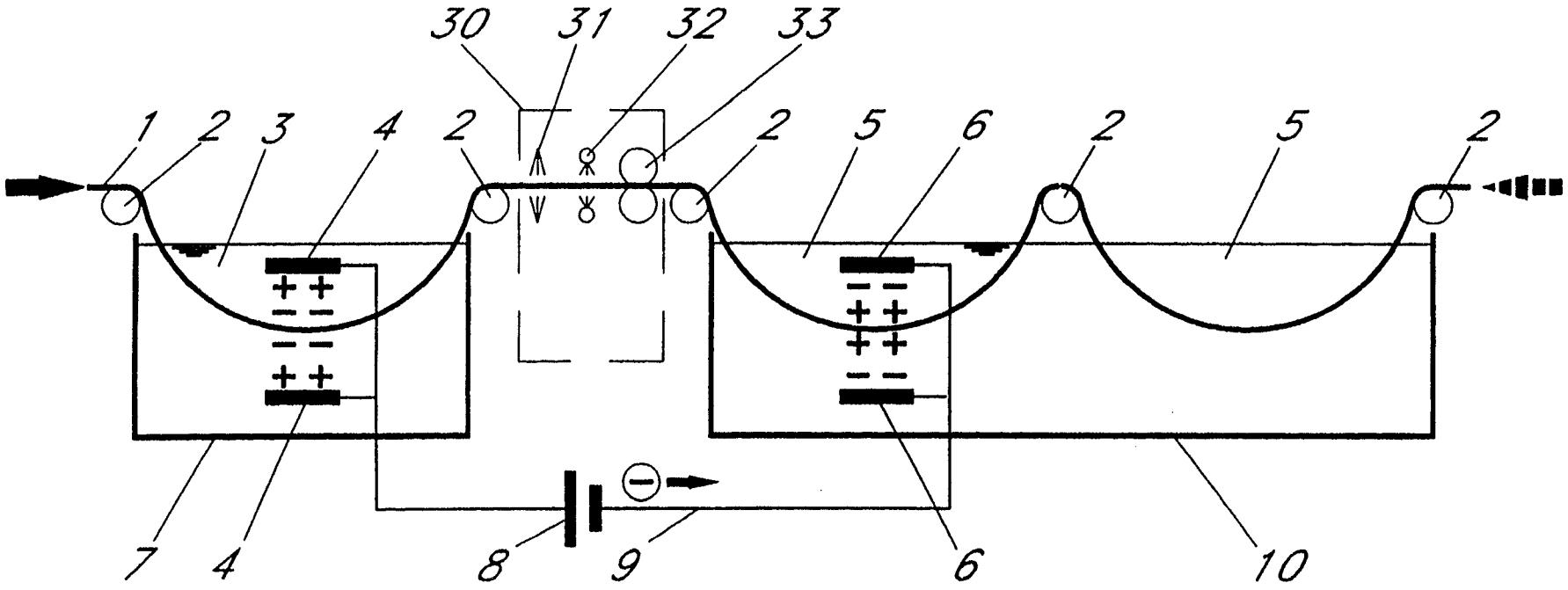
Figure 5B:
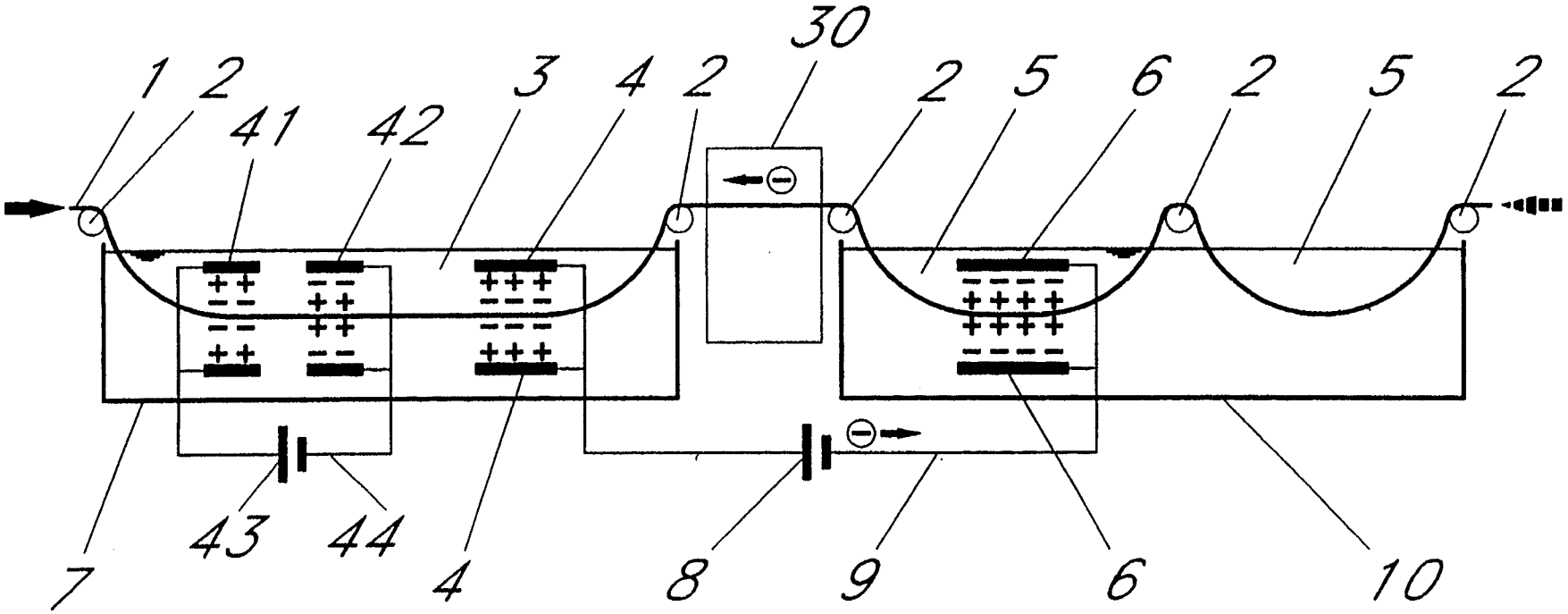

FIG. 4 shows a treatment unit in which in the vessel 7, in addition to the anode 4, a further cathode-anode pair 41, 42 is employed. These electrodes 41, 42 are interconnected by way of a current source 43 and a conductor 44, whereas in a manner known per se the electrodes 4 are connected by way of the source of current 8 and the conductor 9 to the electrodes 6 in the next following vessel 10. In the vessel 7 the material 1 to be treated is accordingly treated alternatingly cathodically, anodically and once again cathodically, whereas in the vessel 10 an anodic treatment takes place. In the vessel 7 pickling takes place with neutral electrolyte and the electrodes 41, 42 are already present. The electrodes 4, 6 which can be simply installed in the case of pre-existing neutral electrolyte pickling plant will then reinforce the pickling effect in the above described manner. Since the electrolyte 3 is not very aggressive it does not attack the material of the anodes 4, 41, whereas the cathode 42 and in particular the cathode 6 in the aggressive electrolyte 5 are protected due to their polarity as cathodes. In addition to this a cleaning unit 30 is provided as well.

FIG. *5a* illustrates a modification of the invention in which the electrolyte 5 in the vessel 10 has an effect on the strip 1 to be treated even without electrical current support by the electrode 6. This applies, for example, to all electrolytes which also act chemically, such as for example mineral acids. For that reason the vessel 10 is larger than would have been necessary for the purely electrically supported treatment process, and in vessel 10 a region is also provided in which no electrodes are present and where the electrolyte 5 acts on the material to be treated in a purely chemical manner.

As illustrated in FIG. *5b*, the modification of the invention with an electrolyte 5 in the vessel 7, which can also act purely chemically may also provide for a treatment with alternating polarity. The preferred working example for such a plant would be a neutral electrolyte 3 in the vessel 7 while in the sequence of electrodes 41, 42, 4 the strip 1 is treated alternatingly cathodically, anodically and again cathodically, whereas in the vessel 10 only cathodes 6 for anodic treatment of the strip are provided.

The electrolyte 5 in the vessel 10 is once again chemically active analogous to the preceding example, for which reason in the vessel 10 a region is also provided without electrodes 6, i.e. for treatment without electrical support.

Figure 6A:
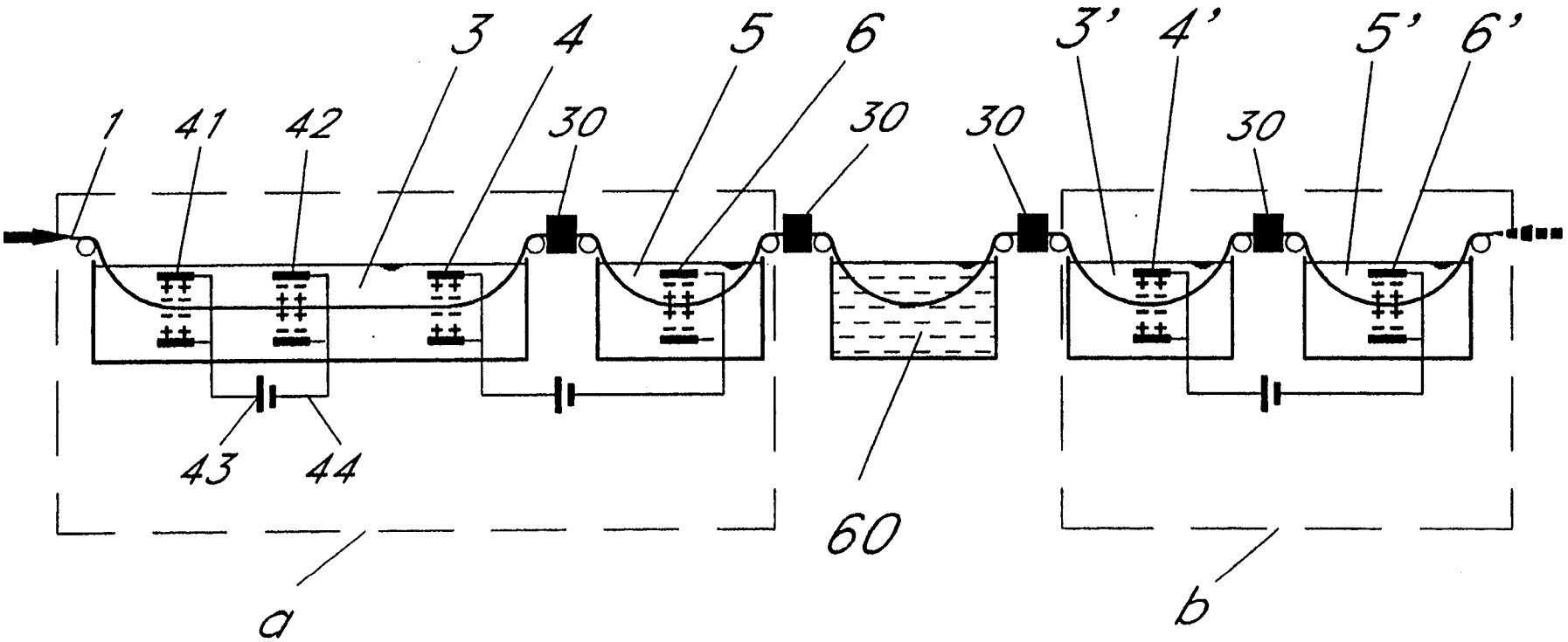
Figure 6B:
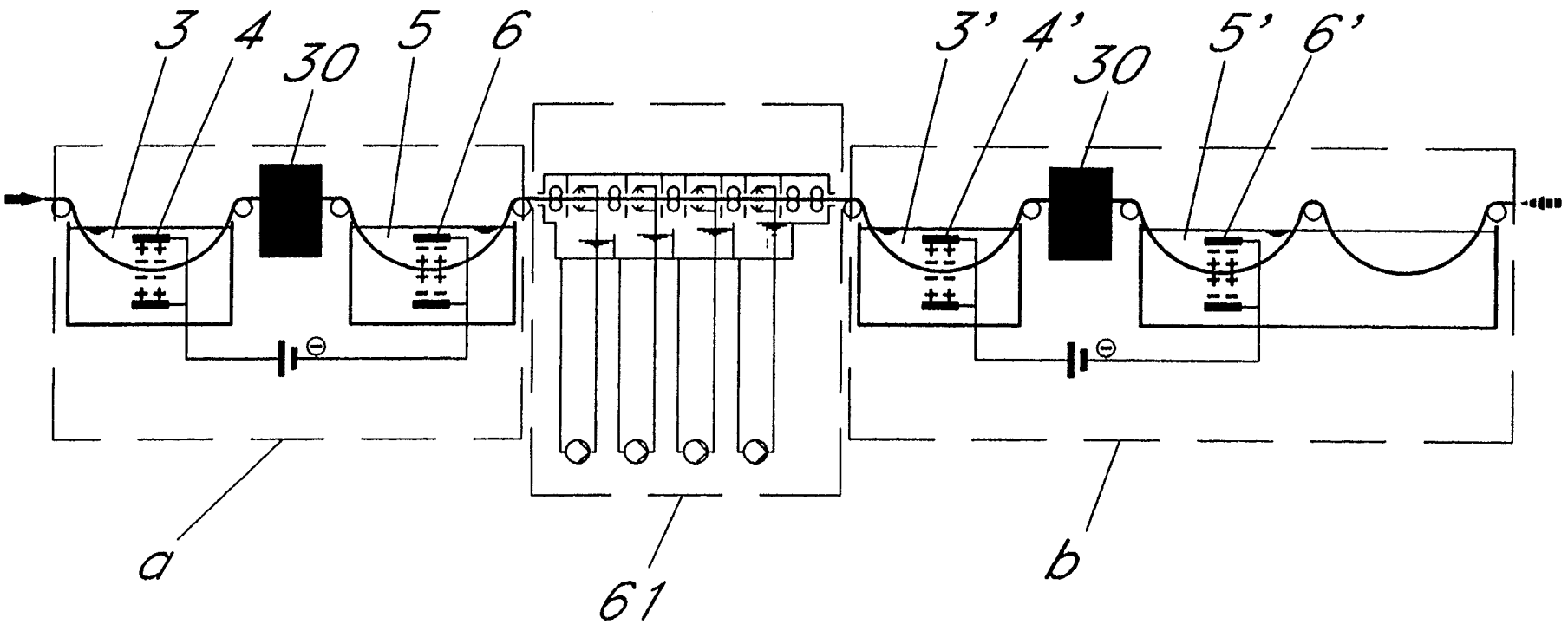

As illustrated by way of example in FIG. 6*a* and 6*b* the arrangements of associated vessels 7 and 10 illustrated in the preceding figures and constituting a treatment unit may also be connected in series in substantially optional sequence. Thus FIG. 6, for example, shows a first treatment unit a, in which an alternatingly cathodic, anodic and again cathodic treatment of the material 1 in a first electrolyte 3 and subsequently an anodic treatment in a second electrolyte 5 take place. Once again the electrodes 4 and 6 arranged in the various vessels are interconnected. The treatment unit b corresponds essentially to the basic embodiment comprising one type of electrode 4', 6' in each of the associated vessels. Between the individual vessels cleaning units 30 are preferably once again provided, and between the two above described treatment units a, b a vessel 60 with a treatment liquor is provided which may serve for neutralising one of the electrolyte 5 or 3' or which respectively may serve for any optionally desired intermediate treatment of the strip 1.

A further example for the two treatment units a, b combined with one another, is illustrated in FIG. 6*b*. In this case the treatment unit a corresponds to the basic embodiment whereas the treatment unit b comprises a vessel in which the electrolyte 5' is also purely chemically active and where accordingly a region is provided in which no electrodes 6' are present in the vessel. Instead of the treatment vessel 60 a multiple stage rinsing installation 61 for the material to be treated is illustrated in this case. This serves to indicate that not only the two illustrated installations 60, 61, but also that optional treatment installation for the continuously passing material may be provided between individual successive treatment units constructed in accordance with the invention.

Figure 7:
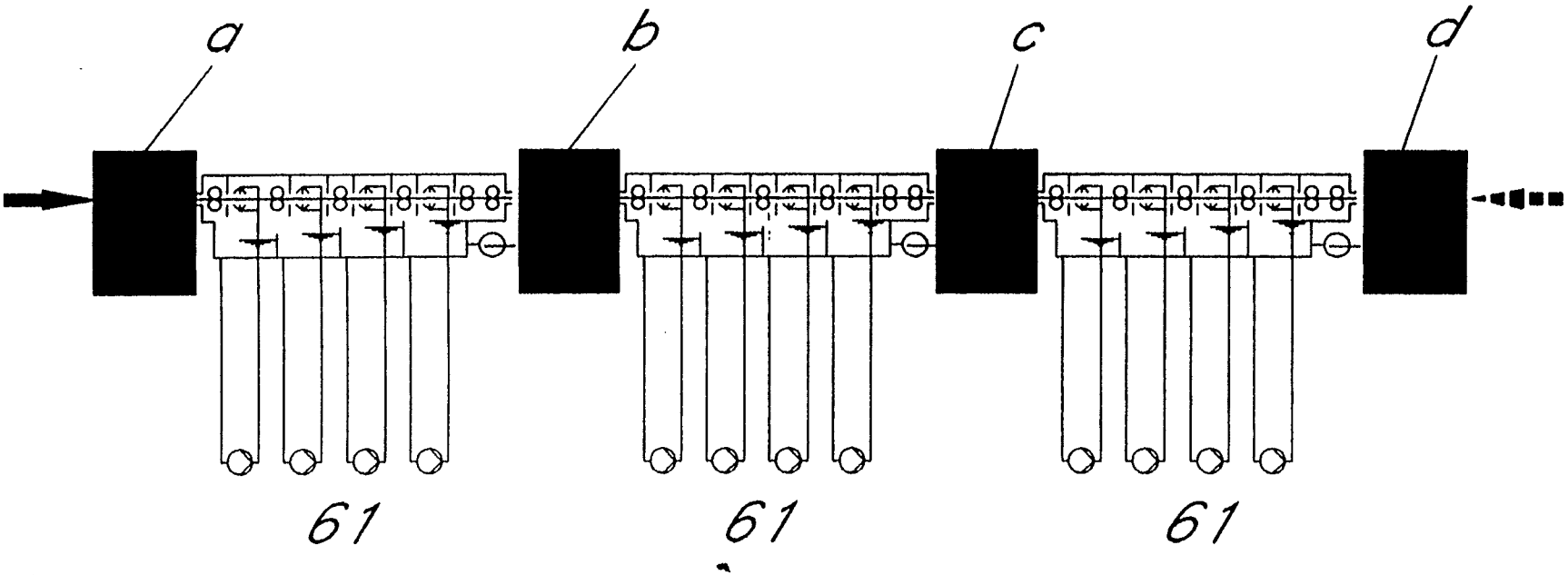

This is also illustrated by way of example in FIG. 7 in which four treatment units a, b, c, d are provided, each being designed according to the invention and, for example as shown in one of the above described figures. Between these individual treatment units a, b, c, d which may be connected in series in optional numbers optional intermediate treatment units are provided as illustrated by way of example in FIG. 7 by three rinsing units 61.

The claims which follow are to be considered an integral part of the present disclosure. Reference numbers (directed to the drawings) shown in the claims serve to facilitate the correlation of integers of the claims with illustrated features of the preferred embodiment(s), but are not intended to restrict in any way the language of the claims to what is shown in the drawings, unless the contrary is clearly apparent from the context.

What we claim is:

1. A process for the electrolytic pickling of continuously advancing electrically conductive material, in particular metal strip, metal wires or metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing an electric circuit between electrodes of different polarities provided in the vessels through which the material passes, which circuit conducts the electric current from at least one anode in the first vessel to at least one cathode in the following vessel, wherein the material in the vessels is treated with electrolytes of different properties and wherein the material between successive vessels is subjected to a treatment for neutralizing carried over electrolyte.

2. An apparatus for electrolytic pickling a continuously advancing electrically conductive material, said apparatus comprising;

at least two vessels (7,10) arranged in immediate succession, viewed in a direction of passage of the material (1), for aqueous electrolytes, the material passing from a first vessel to a following vessel;

means for transporting (2) said material between said vessels;

at least one electrode (4,6) being provided in each vessel and wherein in the first of the vessels (7) at least one anodic electrode (4) is disposed and wherein in the following vessel (10) at least one cathodic electrode is disposed;

an electric circuit for coupling said anodic and cathodic electrodes to an energy source, the electric circuit including that portion of the material transported between the two vessels, wherein between any two of the successive vessels (7,10) cleaning means (30,61) for the material (1) to be treated for inhibiting carried over electrolyte from reaching the following vessel.

3. An apparatus for electrolytic pickling a continuously advancing electrically conductive material, said apparatus comprising:

at least two vessels (7,10) arranged in immediate succession, viewed in a direction of passage of the material (1), for aqueous electrolytes, the material passing from a first vessel to a following vessel;

means for transporting (2) said material between said vessels;

at least one electrode (4,6) being provided in each vessel and wherein in the first of the vessels (7) at least one anodic electrode (4) is disposed and wherein in the following vessel (10) at least one cathodic electrode is disposed;

an electric circuit for coupling said anodic and cathodic electrodes to an energy source,, the electric circuit including that portion of the material transported between the two vessels, wherein between any two vessels containing electrodes of different polarities, an installation (30,60,61) are provided for inhibiting carried over electrolyte from affecting the electrolyte in the following vessel.

4. The apparatus according to claim 3, wherein the successive vessels (7, 10) are charged with aqueous electrolytes (3, 5) having different properties.

5. Apparatus according to claim 4, wherein the electrolytes (3, 5) have different compositions.

6. Apparatus according to claim 4, wherein a first vessel (7) is charged with neutral electrolyte or weakly aggressive electrolyte (3) and an immediately following vessel (10) is charged with aggressive electrolyte (5).

7. Apparatus according to claim 6, wherein the aggressive electrolyte contains fluoride, chloride, sulphate or nitrate ions or combinations thereof.

8. Apparatus according to claim 3 the electrodes of the two vessels are not interconnected.

9. The apparatus according to claim 4, wherein all electrodes (6) in the second vessel (10) are made of the same material.

10. The apparatus of claim 3, wherein said installation comprises a treatment bath for neutralizing the carried over electrolyte.

11. A process for the electrolytic pickling of continuously advancing electrically conductive material, in particular metal strip, metal wires or metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing an electric circuit between electrodes of different polarities provided in the vessels through which the material passes, which circuit conducts the electric current from at least one anode in the first vessel to at least one cathode in the following vessel, wherein the electrolytes are of different compositions and wherein the material between successive vessels is subjected to a treatment for neutralising carried over electrolyte.

12. The according to claim 11, wherein the material in the vessels is treated with electrolytes of different properties.

13. Process according to claim 12, wherein the electrolytes are of different compositions.

14. A process for the electrolytic pickling of continuously advancing electrically conductive material, in particular metal strip metal wires or metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing an electric circuit between electrodes of different polarities provided in the vessels through which the material passes, which circuit conducts the electric current from at least one anode in the first vessel to at least one cathode in the following vessel, wherein the material in the first vessel is subjected to a treatment in a neutral electrolyte or only slightly aggressive electrolyte and in the next following vessel to a treatment in a more aggressive electrolyte and wherein the material between successive vessels is subjected to a treatment for neutralising carried over electrolyte.

15. A process for the electrolytic pickling of continuously advancing electrically conductive material, in particular metal strip, metal wiresor metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing an electric circuit between electrodes of different polarities provided in the vessels through which the material passes, which circuit conducts the electric current from at least one anode in the first vessel to at least one cathode in the following vessel, wherein the material in the vessels is treated with electrolytes of different properties and wherein the material is-cleaned of carried over electrolyte at least when exiting from any vessel or when entering into any following vessel.

16. The according to claim 15, wherein the electric current is conducted via the material to be treated between those electrodes which are closest to one another in successive vessels.

17. The process according to claim 15, wherein the material to be treated is passed for the anodic treatment through a vessel the electrolyte of which contains aggressive ions.

18. The process according to claim 17, wherein the aggressive ions are fluoride, chloride or nitrate ions or combinations thereof.

19. The process according the claim 15, wherein the material is polarized cathodically and at a different position is polarized anodically by being guided past at least one anode and at least one cathode spaced from the anode with respect to a direction of travel of the material.

20. Process according to claim 15 wherein wherein the electrolytes are of different compositions.

21. Process according to claim 15 wherein wherein the material in the first vessel is subjected to a treatment in a neutral electrolyte or only slightly aggressive electrolyte and in the next following vessel to a treatment in a more aggressive electrolyte.

22. A process for the electrolytic pickling of continuously advancing electrically conductive material, in particular metal strip, metal wires or metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing all electric circuit between electrodes of different polarities provided in the vessels through which the material passes, which circuit conducts the electric current from at least one anode in the first vessel to at least one cathode in the following vessel, wherein the material in the first vessel is subjected to a treatment in a neutral electrolyte or only slightly aggressive electrolyte and in the next following vessel to a treatment in a more aggressive electrolyte and wherein the material is alternatingly polarized cathodically and then is polarized anodically and is transferred between the last cathodic treatment into an immediately following vessel where the material is polarized anodically for the last time after being cleaned of carried over electrolyte or neutralising said electrolyte.

23. A process for the electrolytic pickling of continuously advancing electrically conductive material, in particular metal strip, metal wires or metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing an electric circuit between electrodes of different polarities provided in the vessels through which the material passes, which circuit conducts the electric current from at least one anode in the first vessel to at least one cathode in the following vessel, wherein the material is passed through a plurality of treatment units each of which consists of at least two vessels and wherein the material is cleaned of carried over electrolyte or said electrolyte is neutralised between said treatment units.

24. A process Process for the electrolytic pickling of continuously advancing electrically conductive material, in particular metal strip, metal wires or metal profiles, by passing the material through at least two vessels charged with aqueous electrolyte and comprising the steps of:

passing the material through a first vessel in which it is polarized cathodically;

thereafter passing the material through an immediately following vessel in which the material is polarized anodically; and completing an electric circuit between electrodes of different polarities provided in the vessels through which the material passes, which circuit conducts the electric current from at least one anode in the first vessel to at least one cathode in the following vessel, wherein during stand down periods of the plant, in event of material being treated having been removed or like causes, at least the cathode in vessels containing only cathodes are supplied with a protective voltage which prevents damage or erosion of the cathode material.

* * * * *